US008459273B2

(12) United States Patent
Silva

(10) Patent No.: US 8,459,273 B2
(45) Date of Patent: Jun. 11, 2013

(54) ACCESSORY FOR USE TOGETHER WITH HAIR DRYERS

(75) Inventor: Denivaldo Gonçalves Da Silva, New York, NY (US)

(73) Assignee: Daihatsu Industria e Comercio de Moveis e Aparelhos Eletricos Ltda. (BR)

( * ) Notice: Subject to any disclaimer, the term of this patent is extended or adjusted under 35 U.S.C. 154(b) by 740 days.

(21) Appl. No.: 12/374,781

(22) PCT Filed: Apr. 4, 2007

(86) PCT No.: PCT/BR2007/000080

§ 371 (c)(1),
(2), (4) Date: Jan. 22, 2009

(87) PCT Pub. No.: WO2008/014577

PCT Pub. Date: Feb. 7, 2008

(65) Prior Publication Data

US 2009/0320873 A1 Dec. 31, 2009

(30) Foreign Application Priority Data

Aug. 4, 2006 (BR) ..... 0603255
Mar. 23, 2007 (BR) ..... 0603255

(51) Int. Cl.
*A45D 20/08* (2006.01)

(52) U.S. Cl.
USPC ..... 132/271

(58) Field of Classification Search
USPC ... 132/270; 15/339, 396, 398, 415.1; 2/161.7; 34/96, 97
See application file for complete search history.

(56) References Cited

U.S. PATENT DOCUMENTS

| | | | | | |
|---|---|---|---|---|---|
| 1,012,634 | A | * | 12/1911 | Guild | 15/398 |
| 1,431,943 | A | * | 10/1922 | Gee | 132/114 |
| 3,082,466 | A | * | 3/1963 | Tucker et al. | 15/415.1 |
| 4,620,374 | A | | 11/1986 | Patterson | |
| 4,809,365 | A | * | 3/1989 | Chen et al. | 2/168 |
| 5,289,642 | A | * | 3/1994 | Sloan | 34/104 |
| 5,526,578 | A | | 6/1996 | Iyer | |
| 5,718,016 | A | * | 2/1998 | Sung | 15/339 |
| 5,845,656 | A | * | 12/1998 | Assmann | 132/271 |
| 5,944,031 | A | | 8/1999 | Farley et al. | |
| 2002/0166156 | A1 | * | 11/2002 | Clark et al. | 2/161.7 |

FOREIGN PATENT DOCUMENTS

| | | | |
|---|---|---|---|
| GB | 2 414 180 | A | 11/2005 |
| WO | WO 02/060296 | A1 | 8/2002 |

* cited by examiner

*Primary Examiner* — Robyn Doan
(74) *Attorney, Agent, or Firm* — Cantor Colburn LLP

(57) ABSTRACT

Accessory for use together with hair dryers including a hollow part and a monobloc, preferably obtained from an injected piece of plastic which has a connection terminal. The connection terminal has a tubular body and is dimensioned for coupling by locking to an end of a hair dryer. The connection terminal is disposed in an intermediate chamber. A plurality of hollow projections extend from the connection terminal. Each of the hollow projections diverts an air flow from the hair dryer to a series of openings disposed in the hollow projections and the body of the intermediate chamber.

7 Claims, 27 Drawing Sheets

CUT A-A

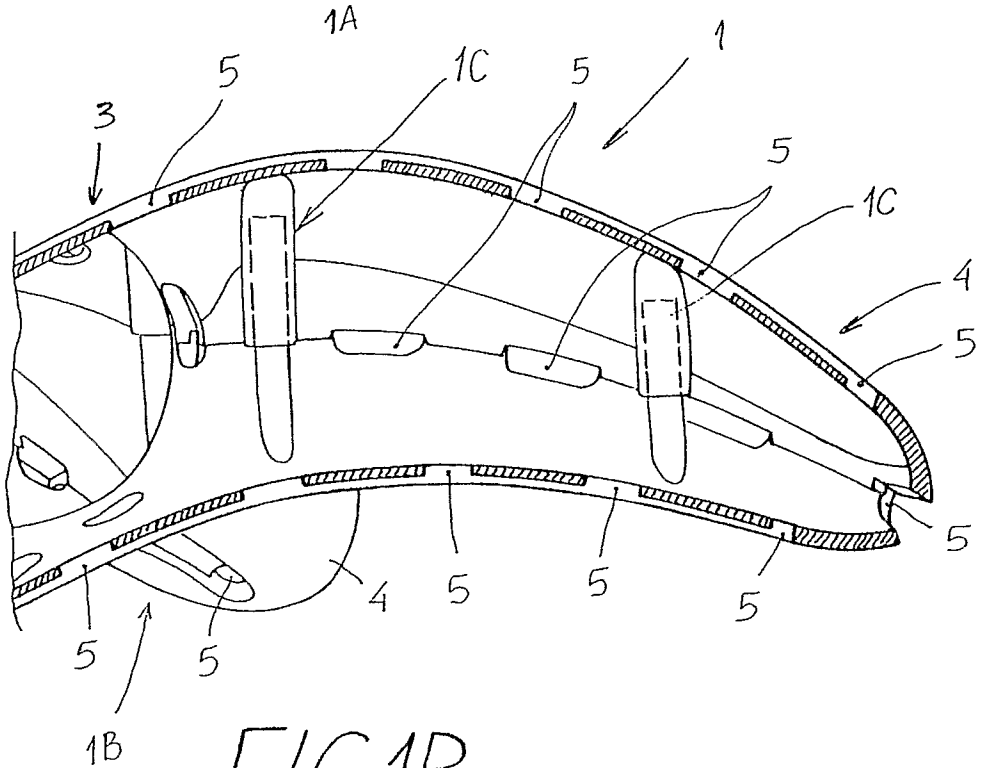
FIG. 1B CUT B-B

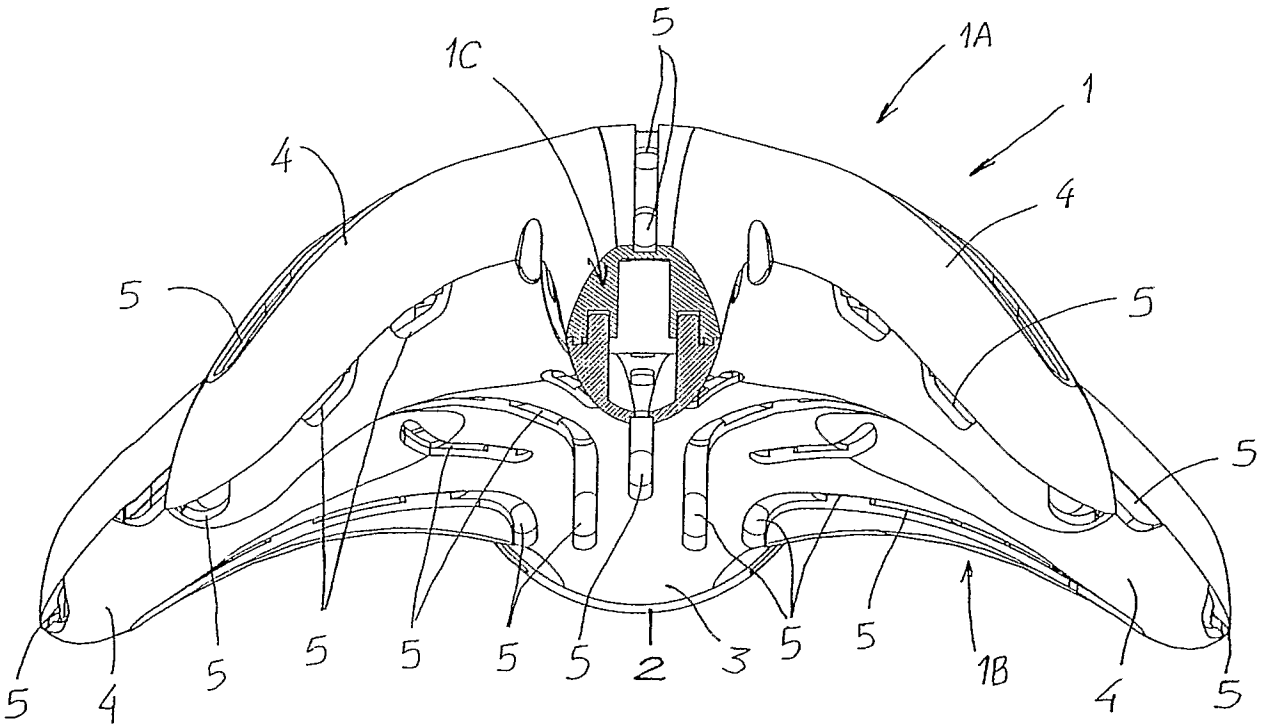
FIG.1C CUT C-C

ACCESSORY FOR USE TOGETHER WITH HAIR DRYERS

The present Invention patent describes an accessory developed especially to be used together with manual type hair dryers, which has the purpose of allowing a better distribution of the air flow among the hair volume during the drying process.

As it is of general knowledge, a wide range of accessories for use with hair dryers is largely known, which are normally parts destined for assembly at the device's air exit end.

Some accessories have the purpose of concentrating the air flow or also to make such flow essentially turbulent or even to produce differentiated flow diffusion under certain conditions.

In the case of drying of dense or voluminous hair, it is normal that professionals helps the drying process through movements with the fingers from the bottom up aiming at thus creating spaces through which the air coming from the hair dryer may enter and thus speeding up the drying process.

This kind of technique thus requires the professional to have both hands permanently busy, i.e. one that holds and operates the dryer and another one that moves the hair during the drying process.

In view of this state of the art, it was developed a special type of accessory which allows taking the flow of heated (or not) air to the inside of the hair volume and in an analog, but perfected form reproduces the effect of the movements that the professional makes directly with one of his hands, such as already described.

The accessory here described was developed to be directly coupled to the air exit end of a generic model hair dryer, thus transferring the air flow coming from this device to the interior of the accessory and then directly to the hair to be dried.

The accessory, here dealt with, features a format analog to the human hand, with projections similar to fingers where the air flow exits through the openings that, due to the design of the mentioned projections, deeply enter the center of the volume of the hair to be dried.

The accessory here dealt with shall be described in detail by means of the figures listed below in which:

FIG. 1B illustrates a view in a schematic cut taken of FIG. 1 such as indicated by the cutting line B-B;

FIG. 1C illustrates a view in a schematic cut taken of FIG. 1 such as indicated by the cutting line C-C;

FIG. 6 illustrates a front view of the accessory here dealt with;

FIG. 29 illustrates a schematic view taken of FIG. 24, such as indicates, such as indicated by cut line A'-A';

Figure 1A:
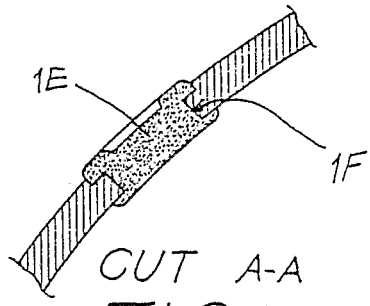
FIG. 1A depicts a detail in a schematic cut taken of FIG. 1 such as indicated by the cutting line A-A.

In accordance with what the listed above figures show, the accessory that is the subject matter of this Invention patent comprises a hollow part 1, preferably obtained in an injected piece of plastic which has a connection terminal 2 that features a format essentially tubular and dimensioned for coupling by locking to the end part of a generic hair dryer model (not illustrated).

The connection terminal 2 is developed in an intermediate chamber 3 from which hollow projections 4 derive that feature a format analog to fingers of a human hand.

The projections 4 (canalize and divide the air flow coming from the dryer and lead such flow to a series of strategically positioned openings 5. The openings 5 are present in both the projections 4 and the body of the intermediate chamber 3.

The hollow part that constitutes the present accessory is composed of two distinct sections, one of which, the main section, is indicated by reference 1A, that encompasses the connection terminal 2 and the upper side of the intermediate chamber 3 and of the hollow projections 4, while the second section or lower section is indicated by reference 1B and defines the lower side of the region of the intermediate chamber 3 and of the hollow projections 4.

Figure 3:
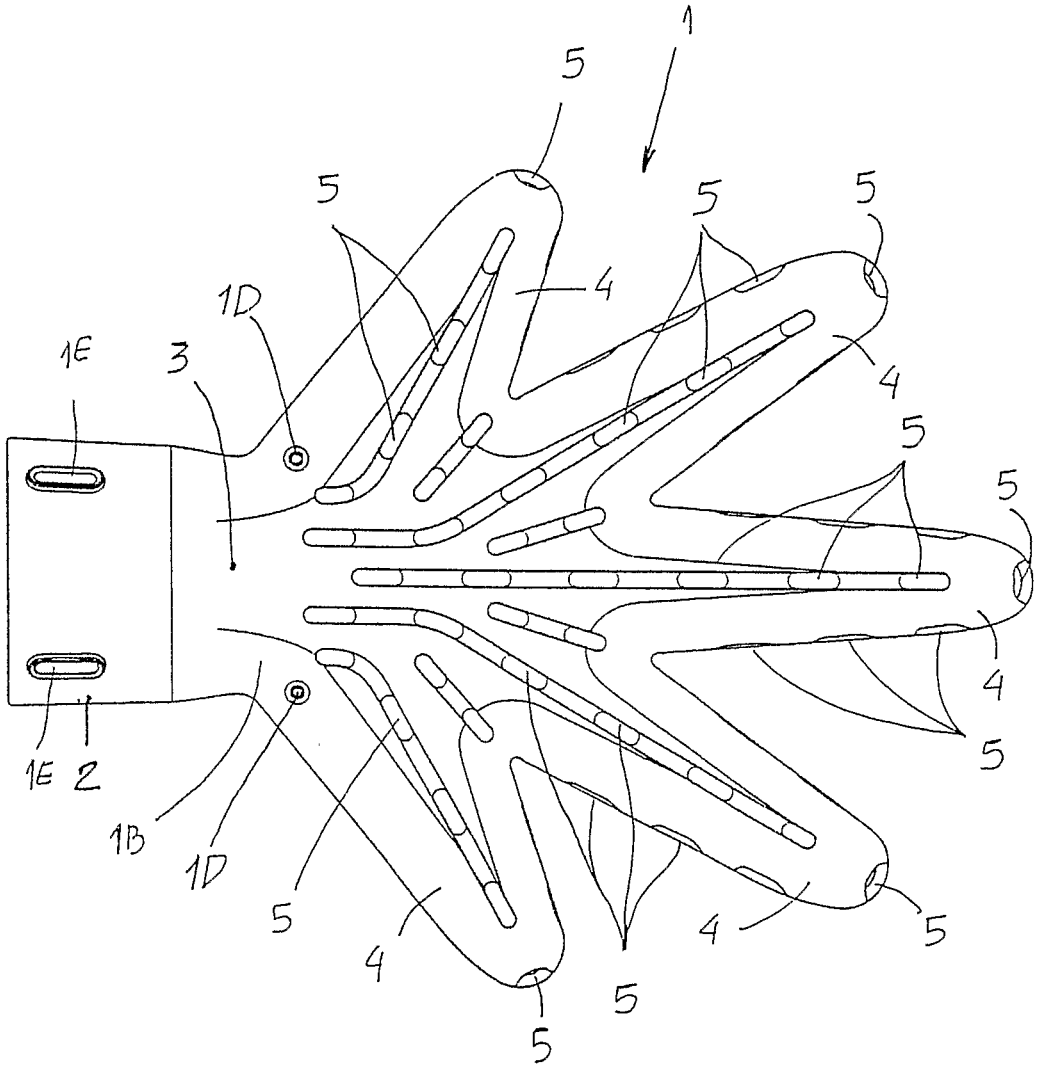
FIG. 3 illustrates a plan view from below of the accessory in question.
Figure 4:
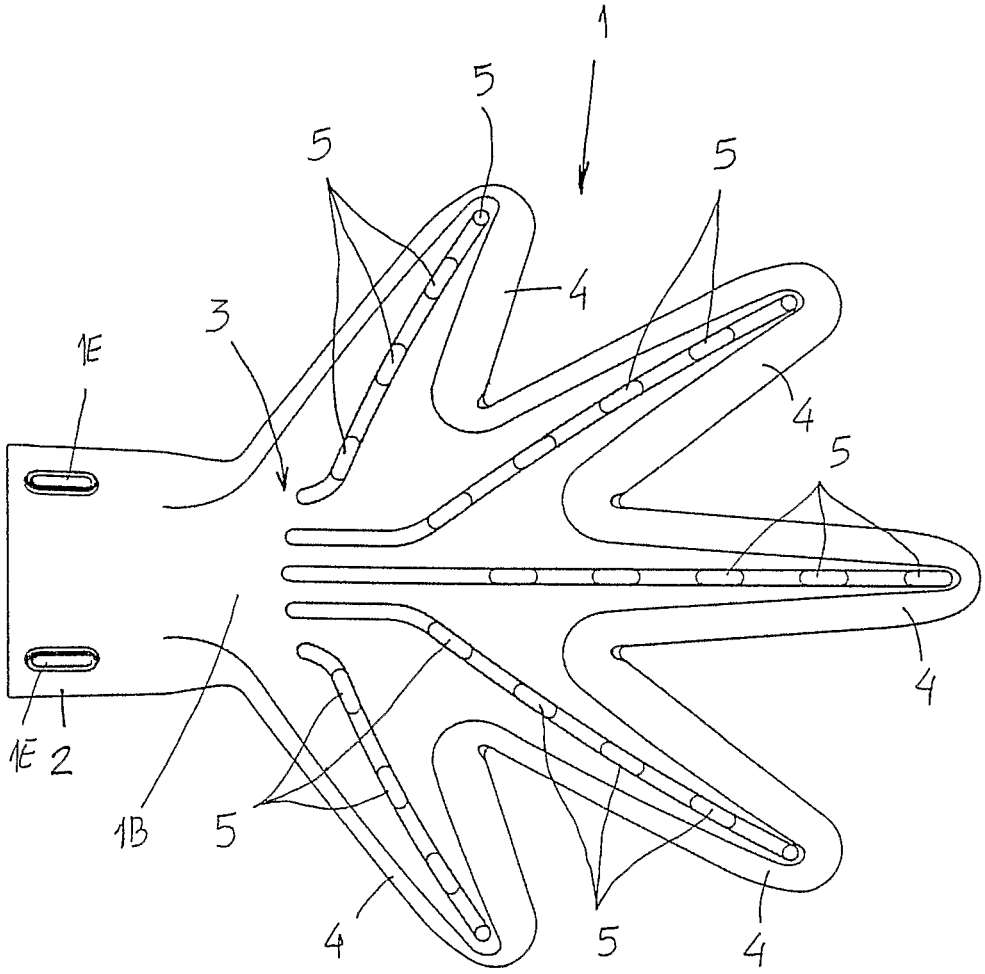
FIG. 4 illustrates a plan view from above of the accessory in question.
Figure 5:
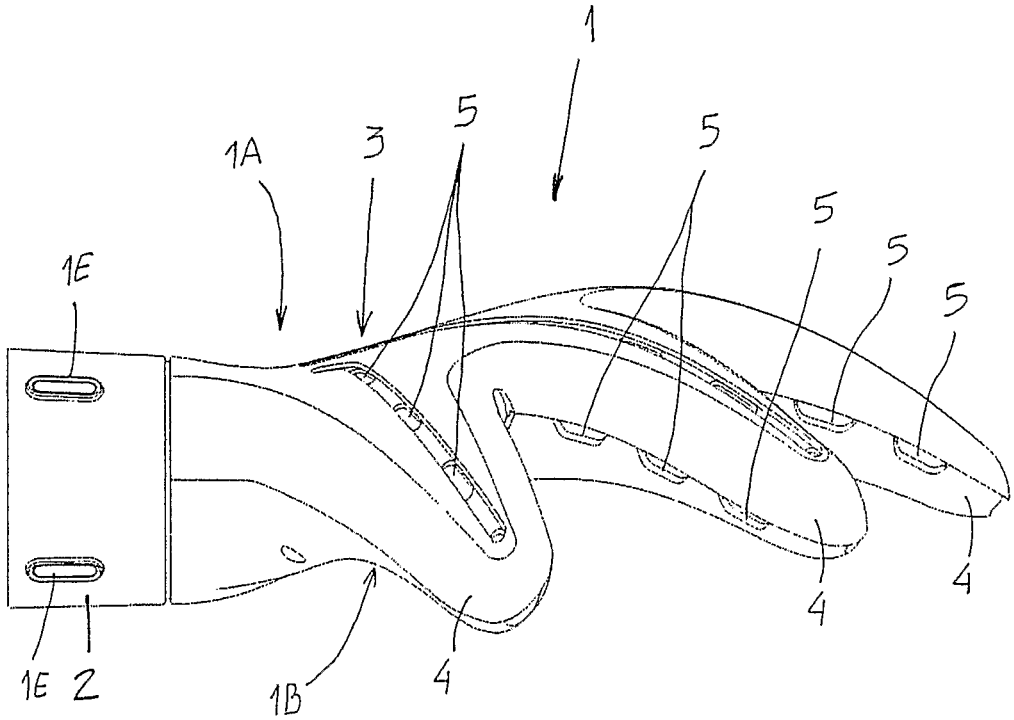
FIG. 5 illustrates a lateral view of the accessory in question.
Figure 7:
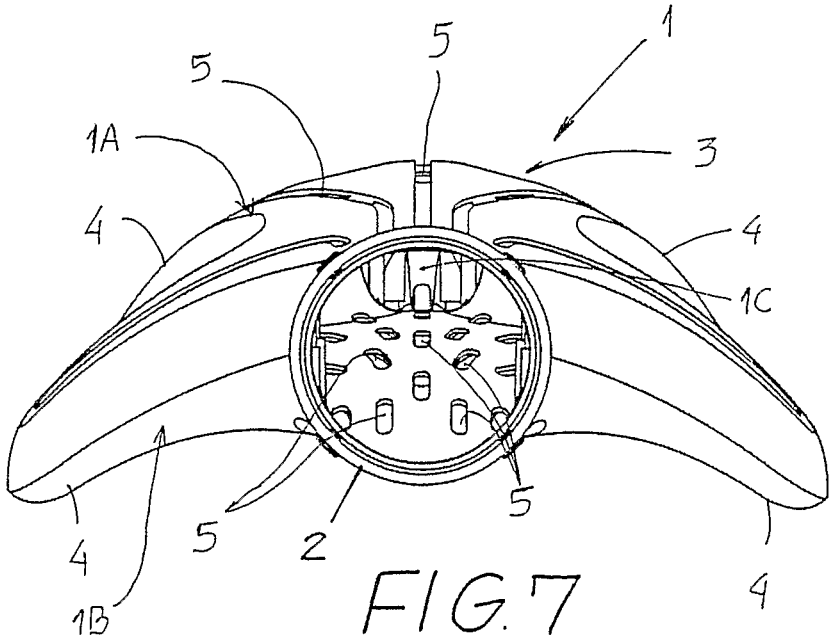
FIG. 7 illustrates a back view of the accessory here described.
Figure 6:
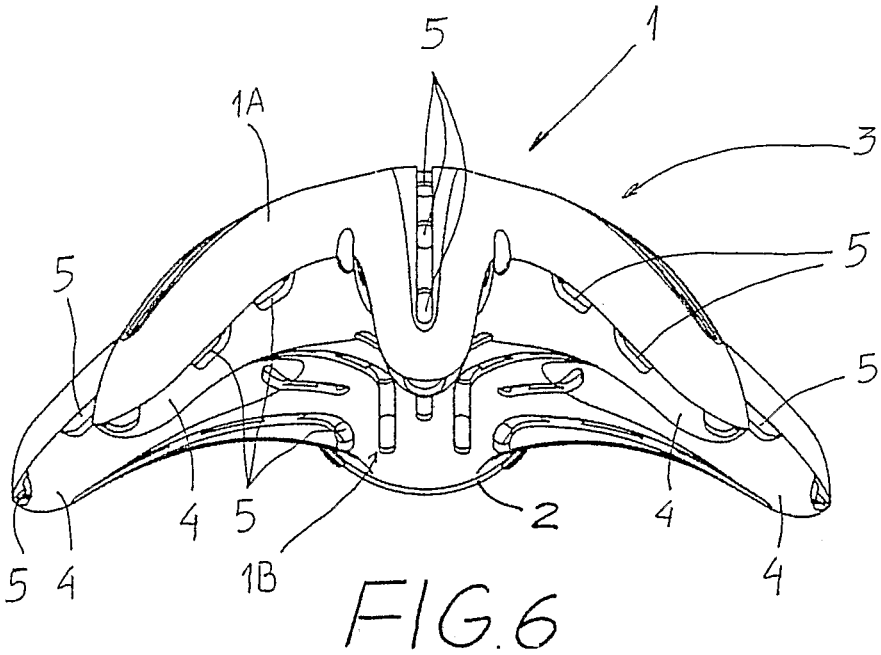
Figure 8:
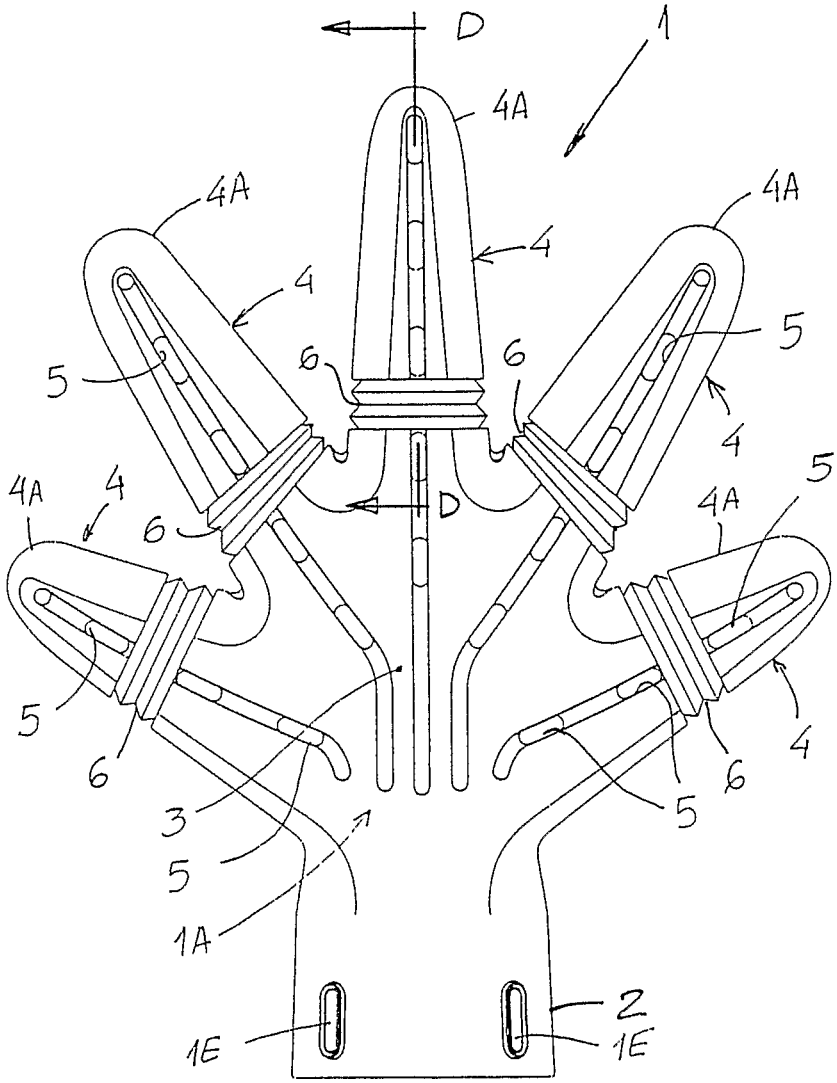
FIG. 8 illustrates a view of a first variation of the present accessory which is a plan view taken from below.
Figure 9:
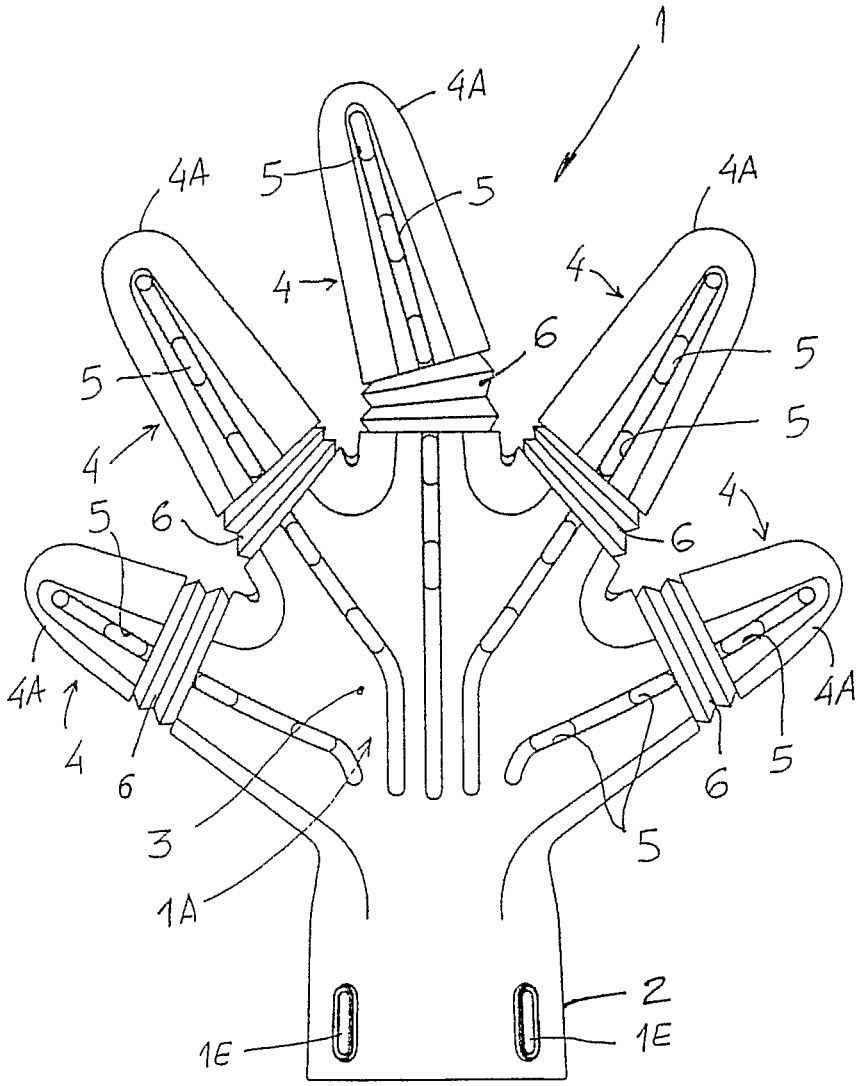
FIG. 9 illustrates a view similar to the first variation, which indicates the possibility of a lateral movement of a projection portion in form of a finger.
Figure 10:
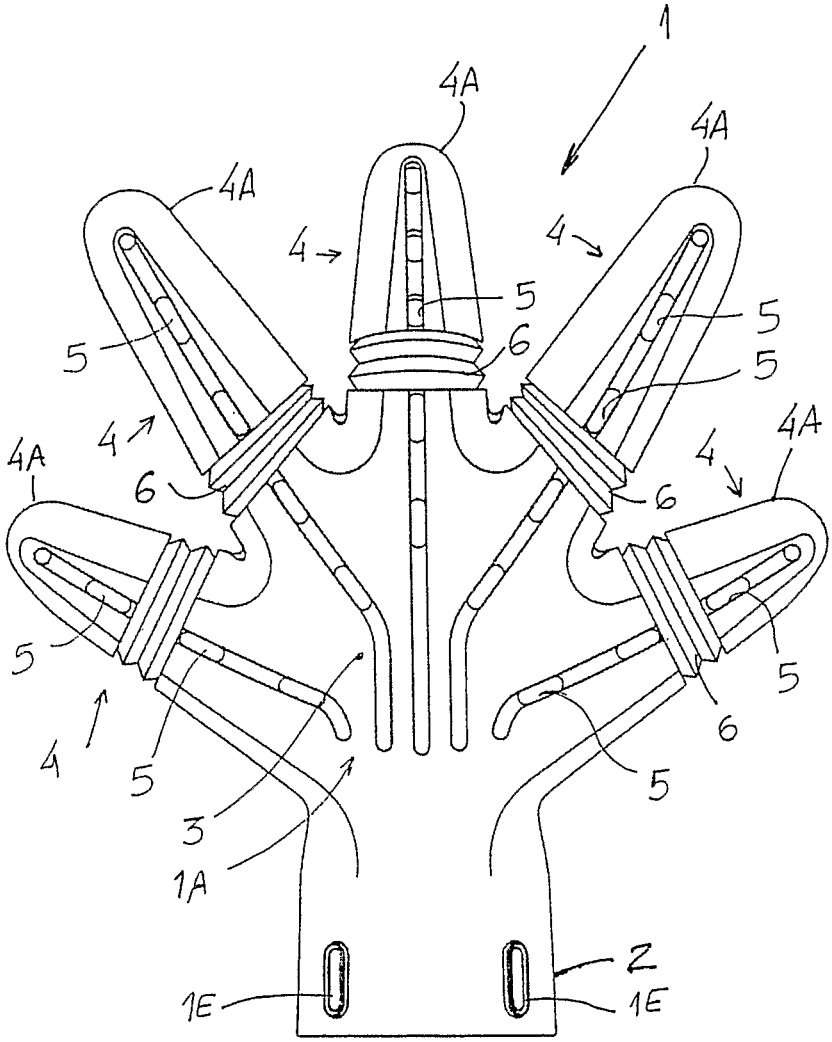
FIG. 10 illustrates a view similar to the one depicted in FIG. 8 where another possibility to move the portion of one of the projections in form of a finger is indicated.
Figure 11:
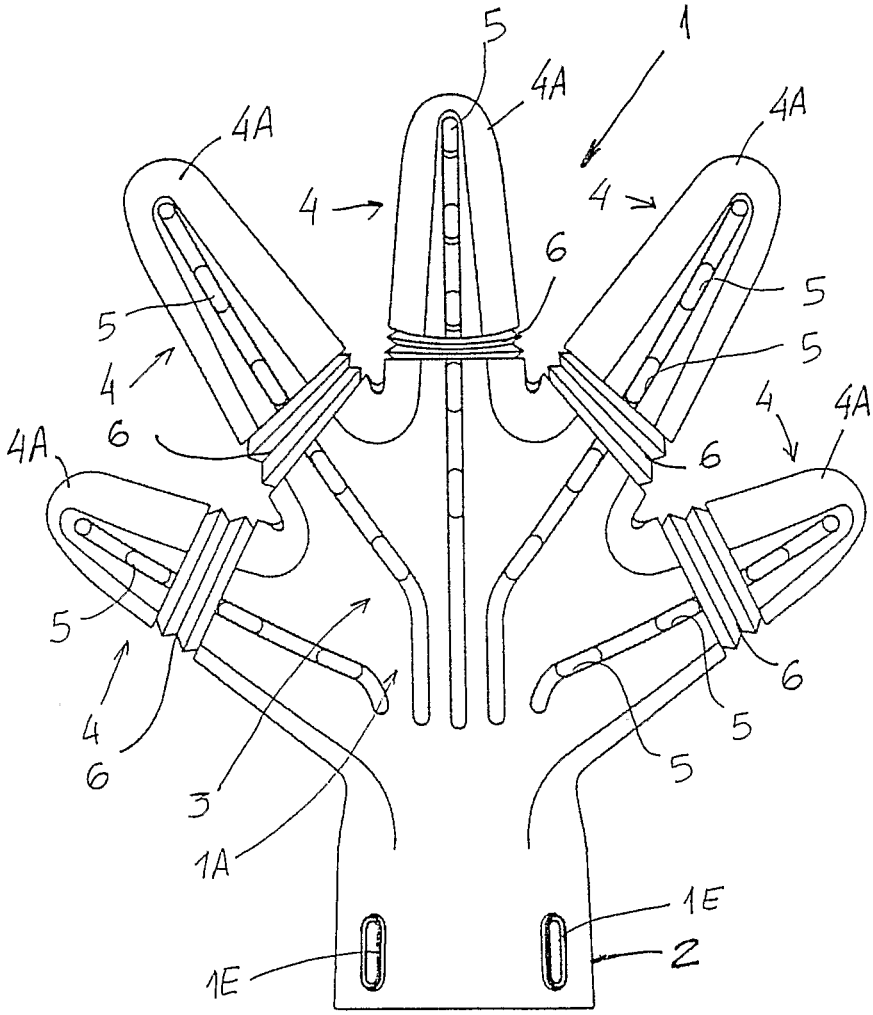
FIG. 11 illustrates another view similar to the one depicted in FIGS. 8, 9 and 10, also showing another possibility to move one projection portion of a finger.
Figure 12:
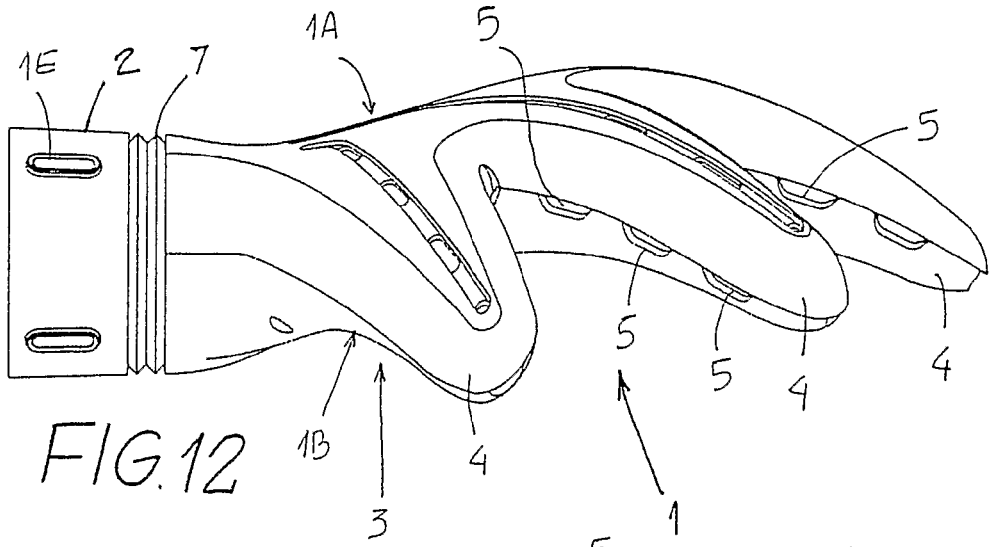
FIG. 12 illustrates a view of a second variation of the accessory here dealt with which is taken as lateral view.
Figure 13:
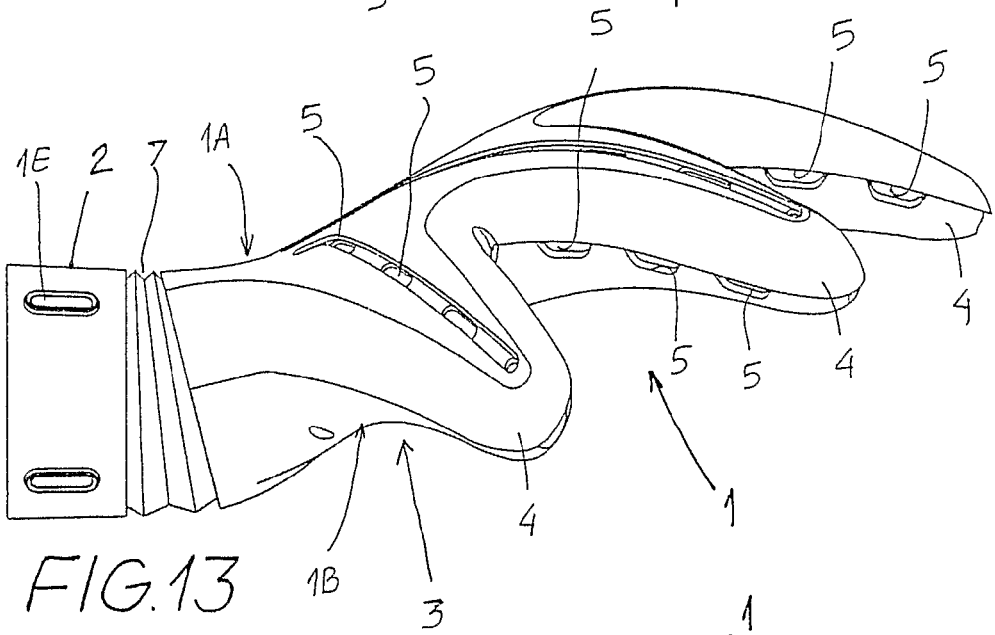
FIGS. 13 and 14 illustrate views similar to the ones depicted in FIG. 12, where the movement possibility of the region of the present accessory is shown analog to the wrist.
Figure 14:
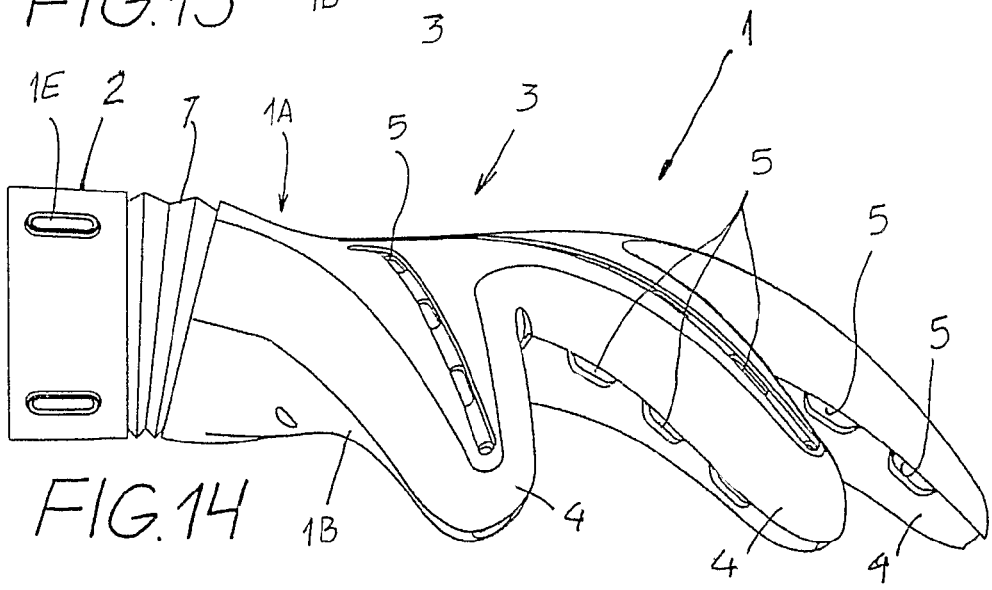
Figure 15:
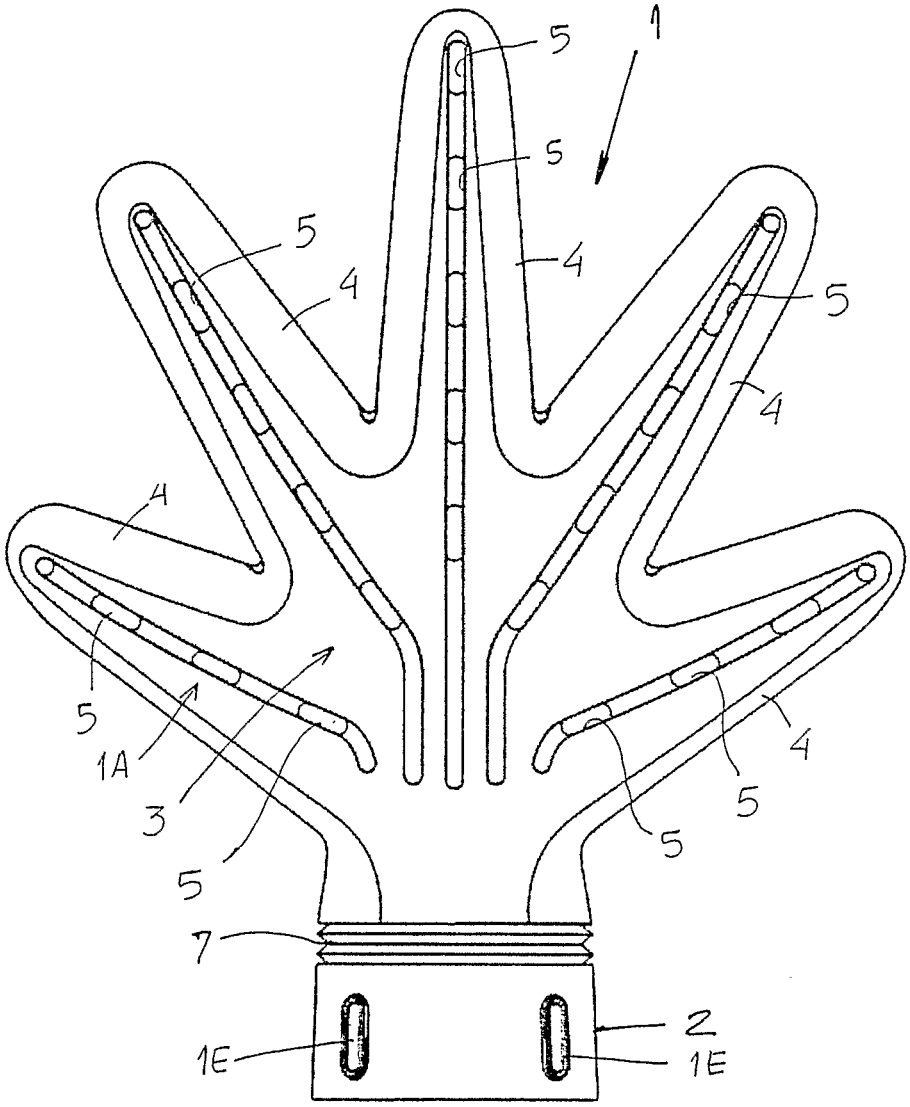
FIG. 15 illustrates a top view of the second variation of the present accessory.
Figure 16:
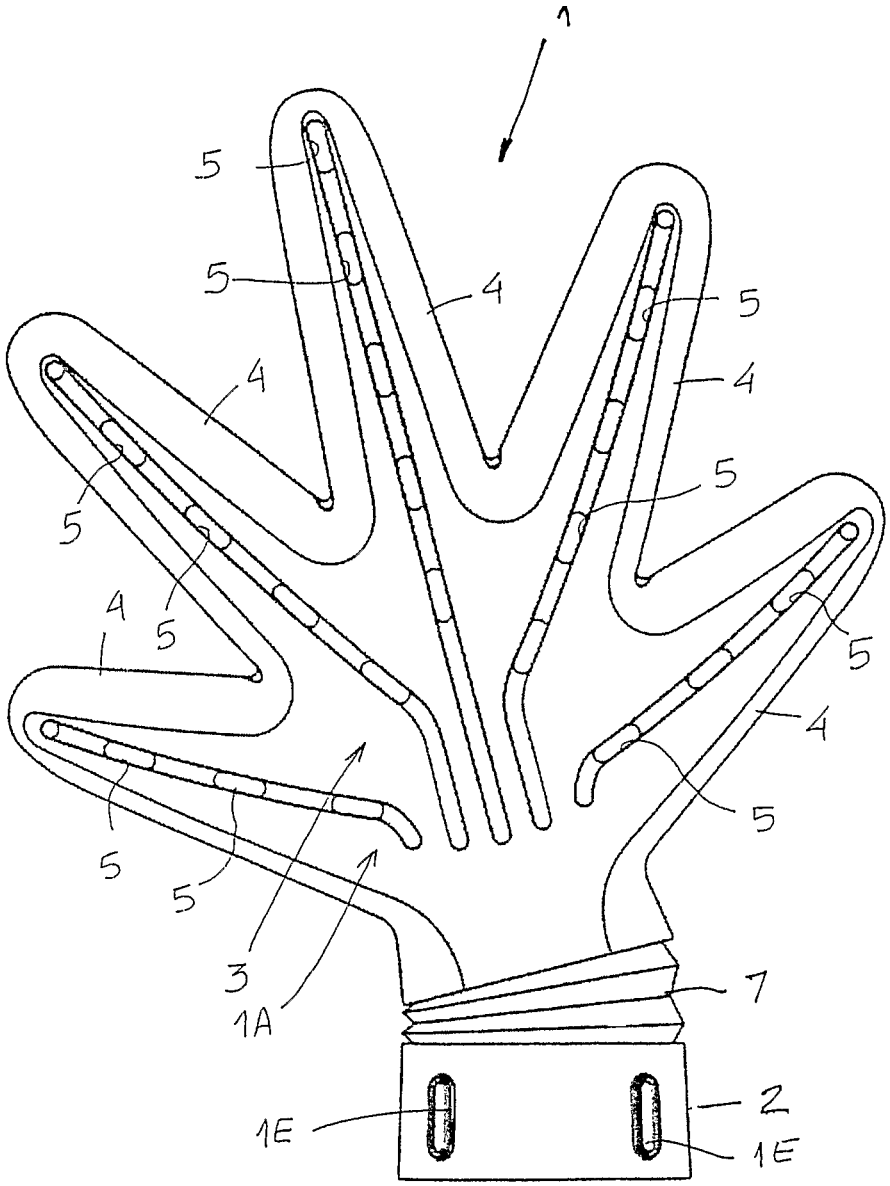
FIGS. 16 and 17 depict other movement possibilities of the present accessory based on the articulation of its region analog to the region of the wrist.
Figure 17:
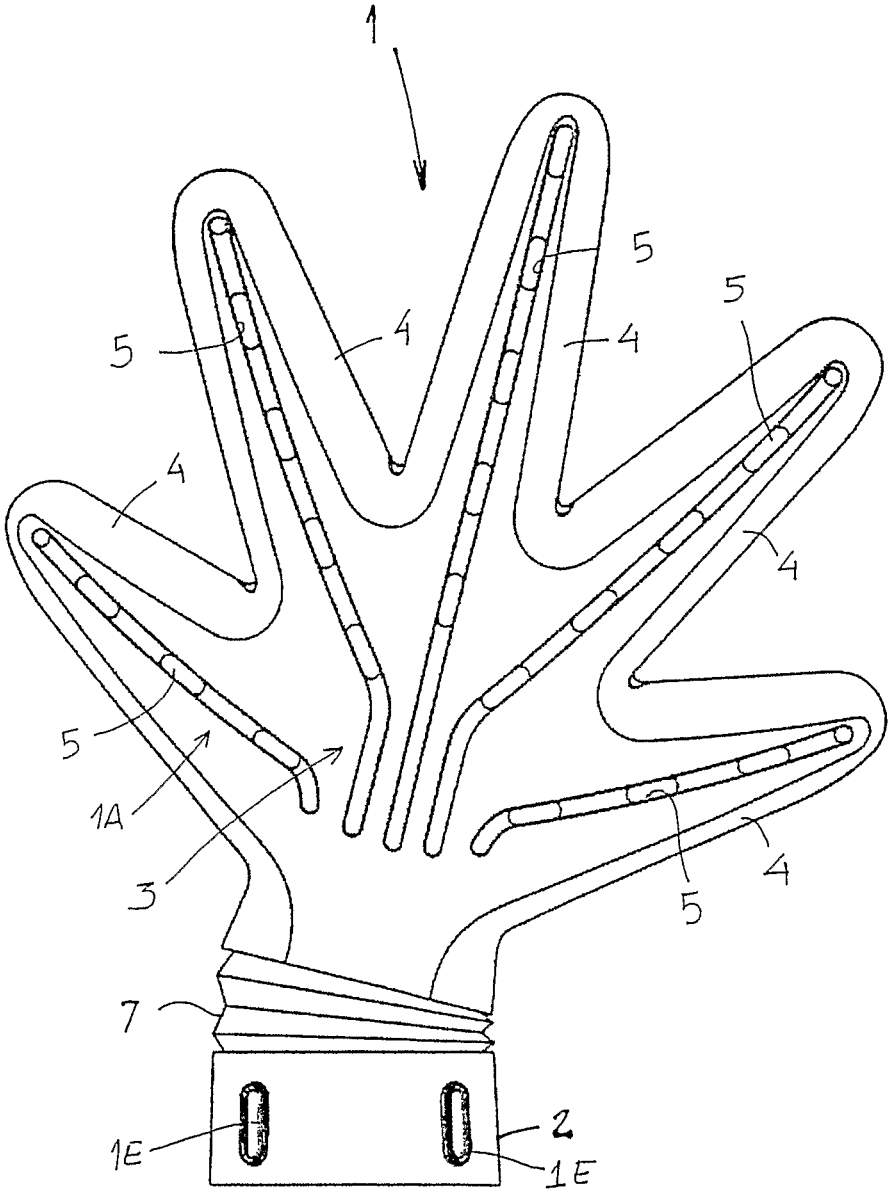

The fixation of the lower section 1B against the main section 1A is made through projections of pins/housing 1C (especially visible in FIGS. 1B and 1C), distributed along the hollow projections 4 as well as through a pair of screws 1D (visible in FIG. 3) that connect the lower section 1B to the main section 1A in the proximity of the connection terminal 2.

Figure 1:
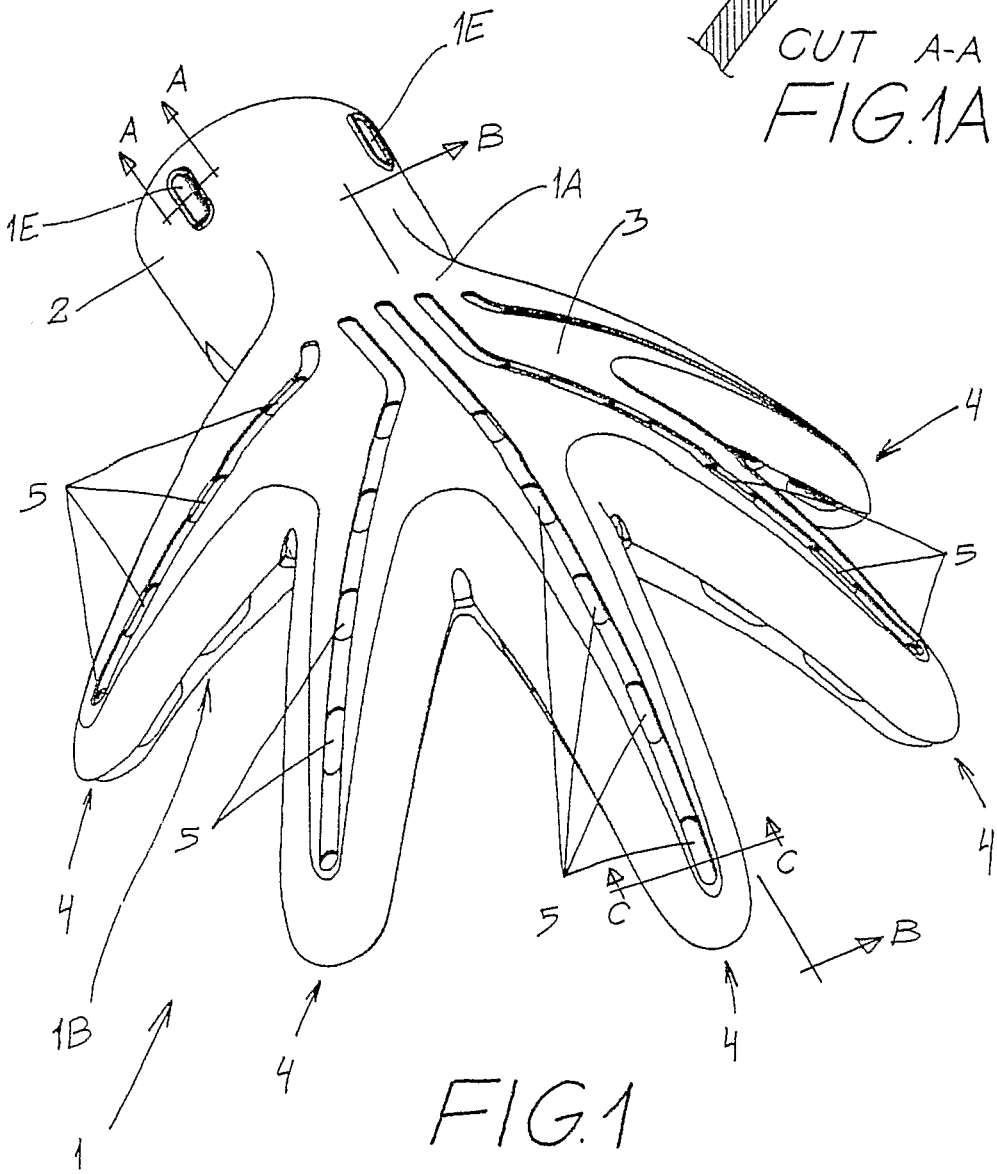
FIG. 1 illustrates a perspective view of the accessory itself, and this view is from the upper angle of the accessory.
Figure 2:
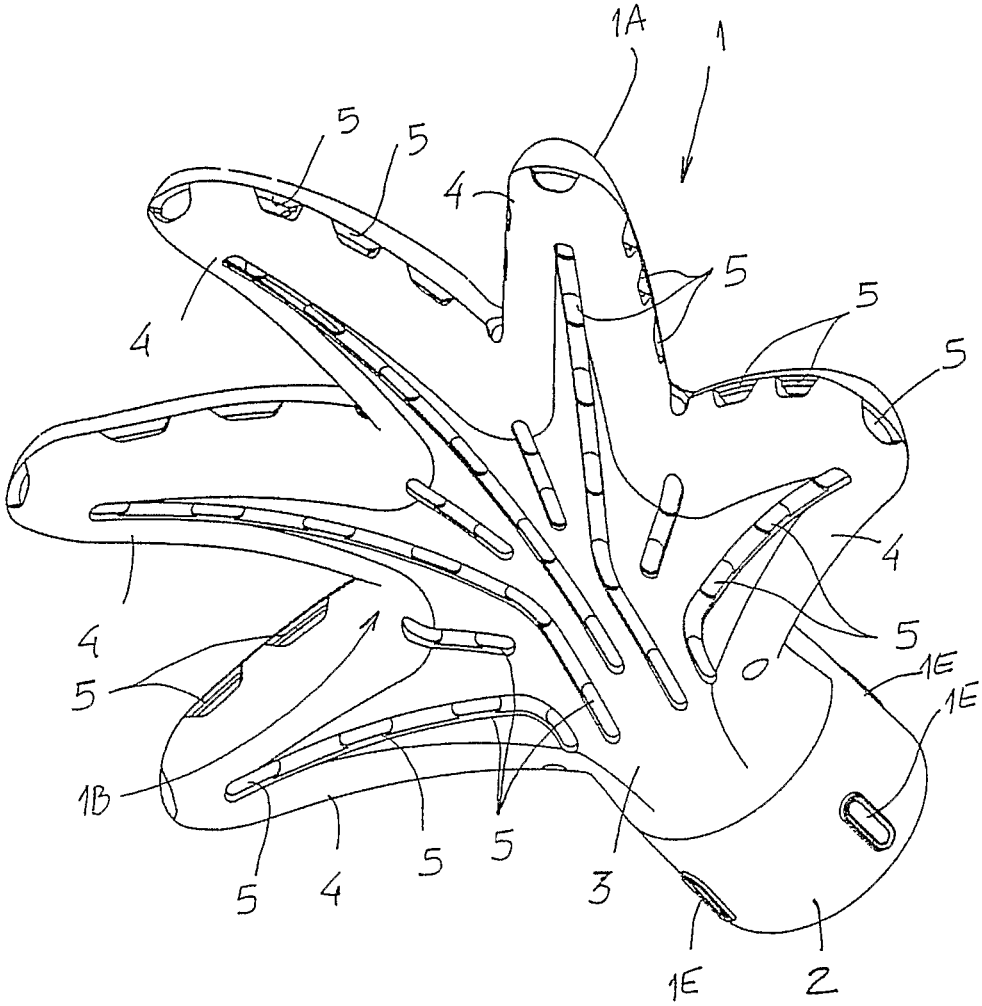
FIG. 2 illustrates a perspective view of the accessory in question, which is taken from its lower angle.

Still with regard to the connection terminal 2, as can be seen in FIGS. 1 and 1A, it has retention components 1E that are defined as rubber inserts assembled in the openings 1F (visible in FIG. 1A) produced in the wall of the connection terminal 2.

The retention components 1E have the function of maintaining contact projections in the interior of the side of the connection terminal 2 that touch the end part of the hair dryer when the accessory here dealt with is introduced. Thus, the fixation of the accessory as a whole to the end part of the hair dryer is made by means of direct friction of the retention components 1E with the wall of the end part of the dryer. The cut of FIG. 1A allows observing that component 1E is assembled in such a way as to be stuck in its respective opening 1F.

In the way of its concretization the accessory here dealt with presents a format that reproduces in a technical way, the general format of the human hand where the projections 4 act analogically to fingers.

The accessory here presented may be projected in such a way as to incorporate a greater or smaller number of projections 4, as its project is not restricted to the number of five projections, such as illustrated.

Figure 18:
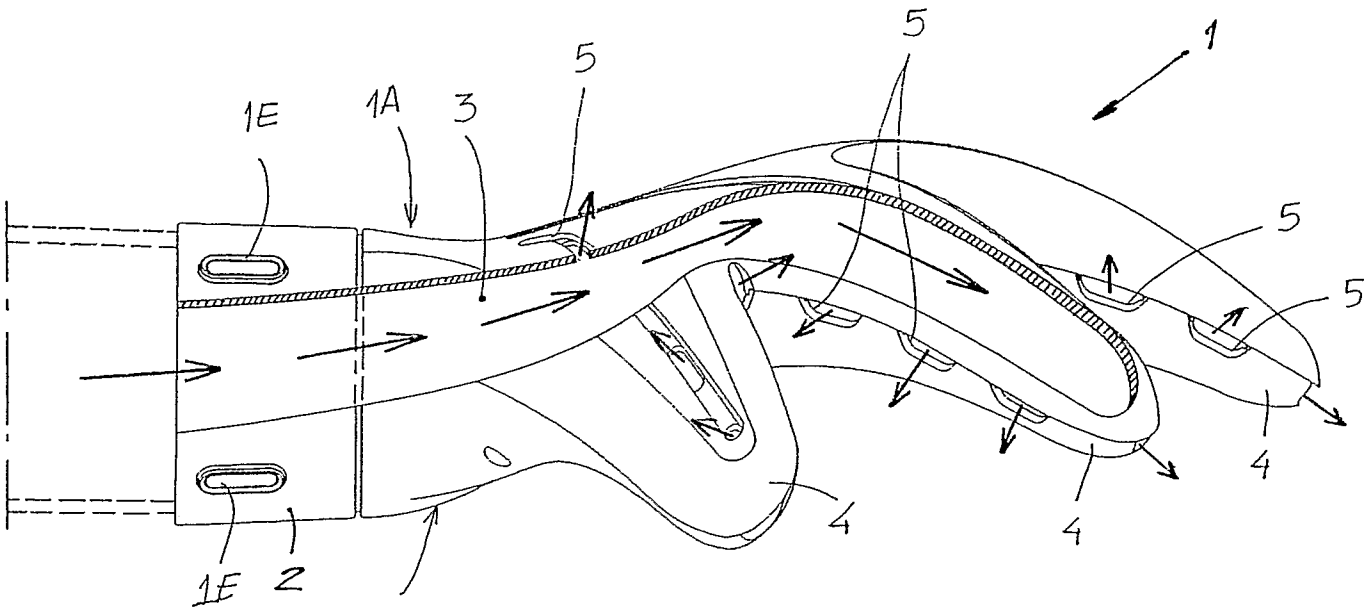
FIG. 18 illustrates a schematic cut of the present accessory where the air flow in its interior is schematically indicated.

FIG. 18 depicts, in a schematic form, the form of the air flow circulation (indicated by means of arrow F) in the interior of the accessory where it can be noted that the flow initially passes through the connection terminal 2, then through the intermediate chamber 3 and after that on to the projections 4, where the flow F, already divided between all projections 4 reaches the respective openings 5.

Figure 19:
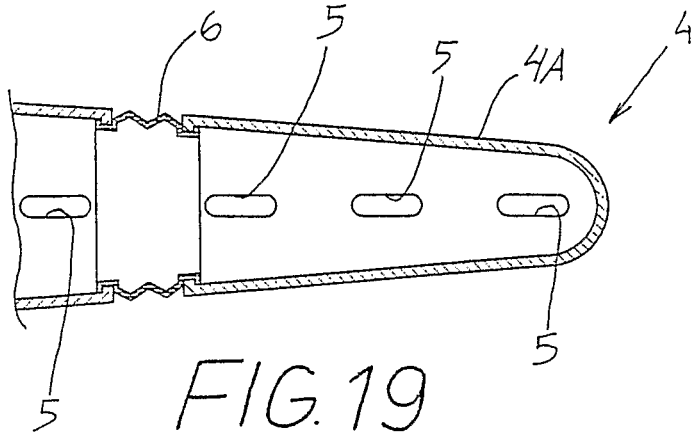
FIG. 19 illustrates a cut taken of the accessory depicted in FIG. 8, such as indicated by the cutting line D-D.

The accessory here dealt with may feature a totally rigid main model (without movable parts), such as demonstrated in FIGS. 1 to 7, whereby also a first variation is foreseen as depicted in FIGS. 8 to 11 where sectors in the form of an accordion 6 are supplied in the very material of which the accessory is manufactured, and such sectors in form of an accordion 6 connect the respective portions of the projections 4 and the movable portions 4A. The construction of the sectors in form of an accordion may be observed better in FIG. 19 where one of the movable projections 4A may be seen in the schematic cut.

As variation of the sectors in form of an accordion 6 that allow for the mobility of the movable portions 4A, a spherical connection 6A may be used alternatively which is incorporated into the end of the movable portion 4A and which is locked into the fix end of the projection 4.

Figure 20:
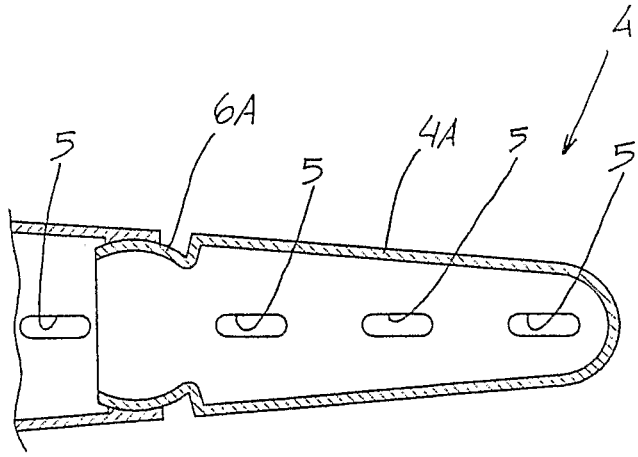
FIG. 20 illustrates a schematic cut of a variation of the concretization featured in FIG. 19.
Figure 21:
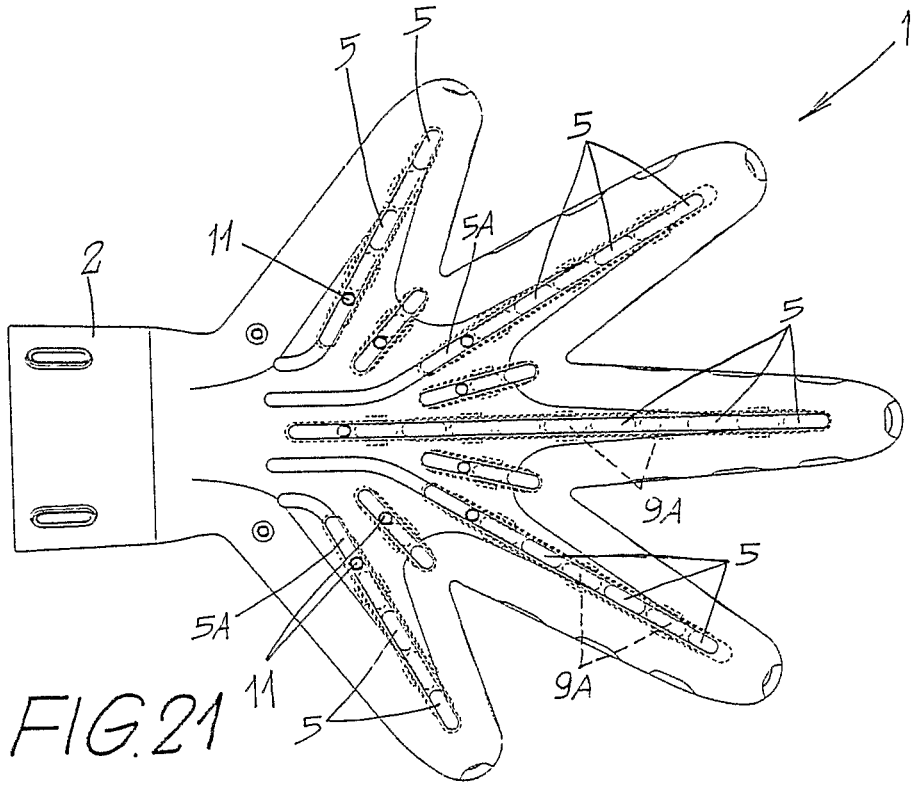
FIG. 21 illustrates a plant view from the lower portion of diffuser object of the present patent, which includes means of controlling the flow in its closed condition.
Figure 22:
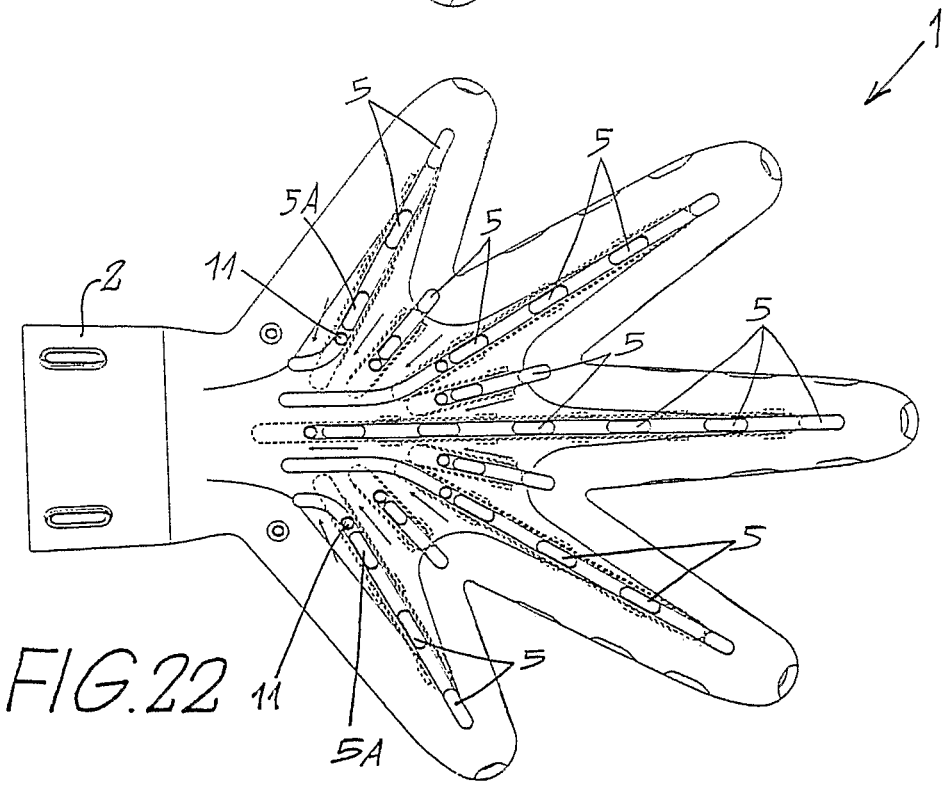
FIG. 22 illustrates a similar view as depicted in FIG. 21, however with means of controlling the flow in its open condition.
Figure 23:
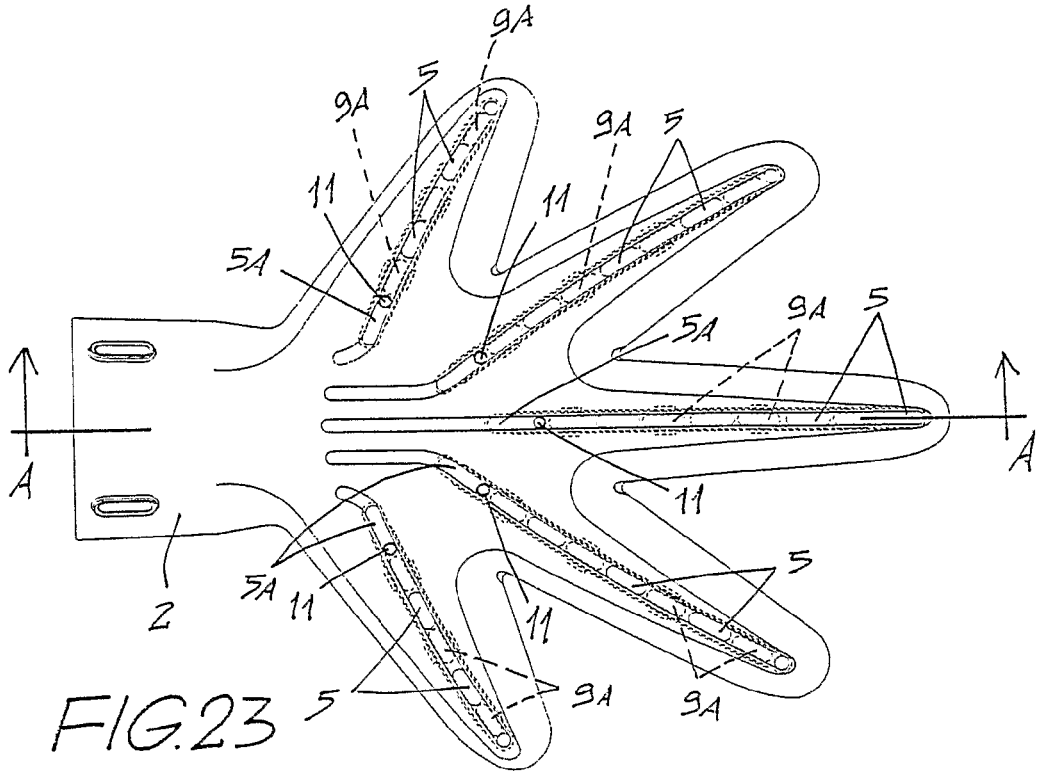
FIG. 23 illustrates a plant view of the upper portion of diffuser object of the present Patent, wherein it is depicted the means of controlling the flow in its closed condition.
Figure 24:
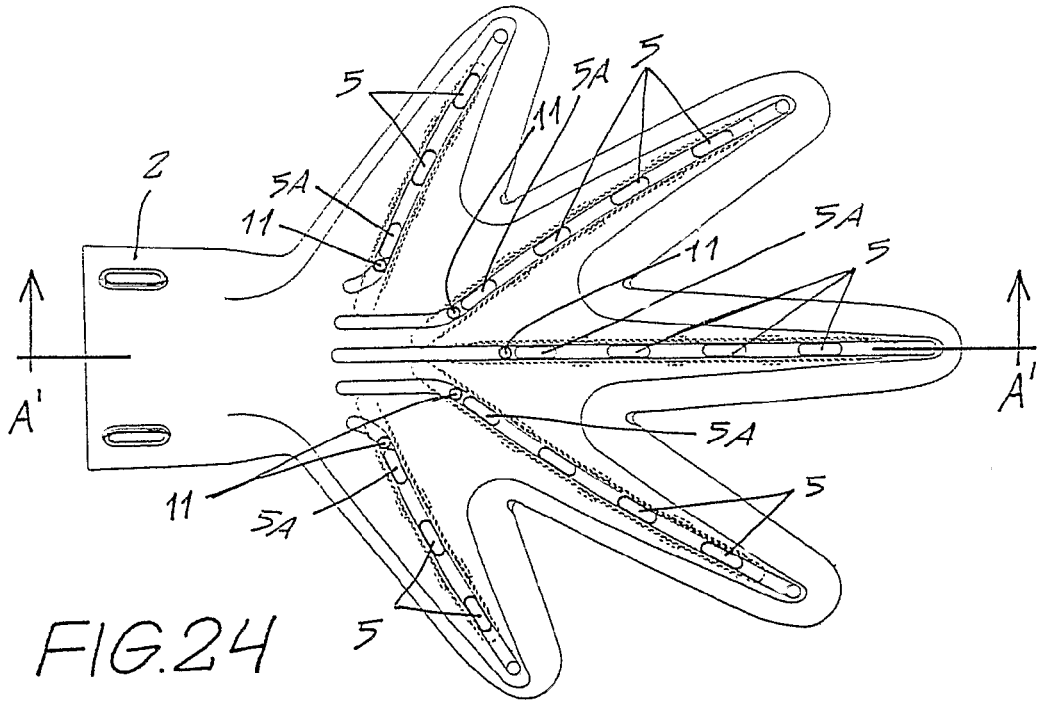
FIG. 24 illustrates a similar view as depicted in FIG. 23, however with means of controlling the flow in its open condition.

The sectors in form of an accordion 6, such as depicted in FIGS. 8 to 11 allow that the movable portions 4A may be adjusted in terms of their positioning in relation to the body of the accessory as a whole, thus allowing better adjustment of their positioning, whereby the same effect is obtained by the construction depicted in FIG. 20 where a spherical connection 6A is foreseen.

Within the same concept of the accessory dealt with in the first variation, which is depicted specifically in FIGS. 12 to 17 and where a sector in form of an accordion 7 is incorporated into the region of the connection terminal 2 allowing movement among the main portion of the accessory and the connection terminal 2 that is normally coupled to the end part of a conventional hair dryer (not illustrated).

The three modalities of the accessory here presented (main model, first and second variation) present the same basic constructive concept, i.e. define a hollow component that, assembled onto the end part of a conventional hair dryer, allows the air flow (whether hot or not) to be directed to the projections 4 and from them the flow may then deeply penetrate, even in the middle of dense and voluminous hair.

The present accessory also includes two variations that deal with forecasting a control system of air flow and means that allow the change in the axial positioning between the accessory and the hair dryer to which it is coupled.

Regarding the provision of means of controlling the flow, the hollow part 1 that constitutes the present accessory may have means of controlling the air flow 8, internally mounted to the diffuser structure, such as can be noted by viewing the FIGS. 25, 26, 27, 28, 29, and 30, said means of controlling the air flow 8 are defined as flexible material strips 9, mounted on trails 10 incorporated in the hollow part structure 1.

Figure 25:
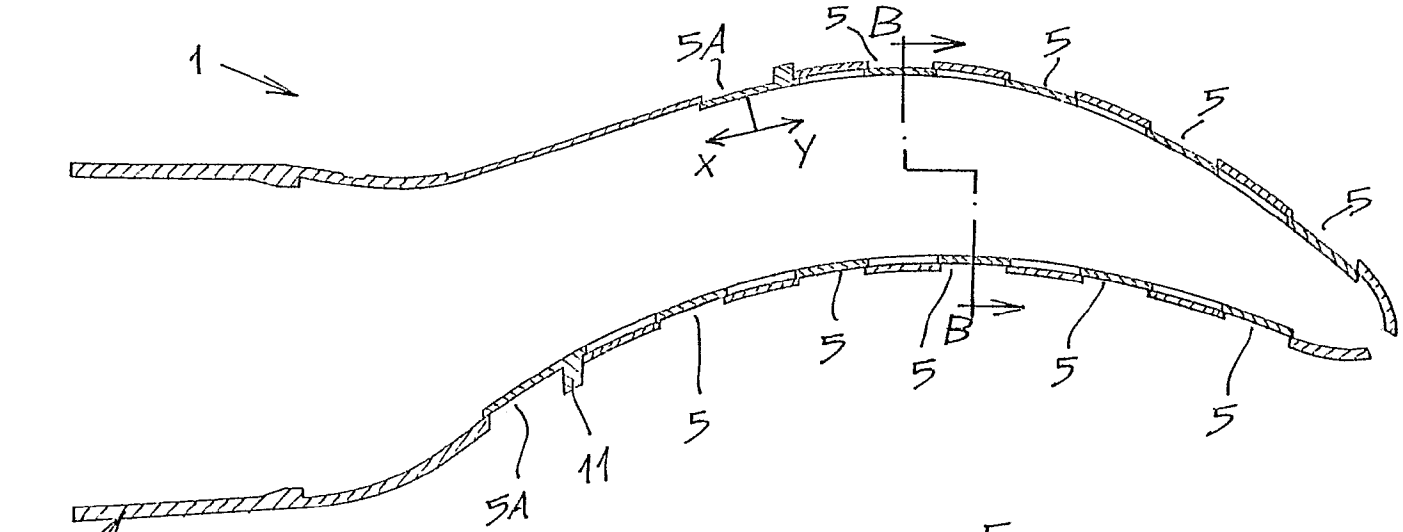
FIG. 25 illustrates a schematic cut taken of FIG. 23, such as indicates schematically FIG. 23, cut line A-A

Said means of controlling the air flow 8 are projected and mounted in order to be dislocated in any way indicated by arrows X-Y, such as demonstrated in FIG. 25, thus allowing openings 9A incorporated in the flexible material strips 9, to be aligned or not with openings 5 provided in the hollow part structure 1.

When the openings 9A are aligned with openings 5, it occurs the passage of air flow through them, and in the opposite way, when said openings are not aligned, it occurs the obstruction of air flow.

There is still the possibility of regulating the flow in the extent that the alignment or not of the openings can be established in several intermediate levels.

Figure 26:
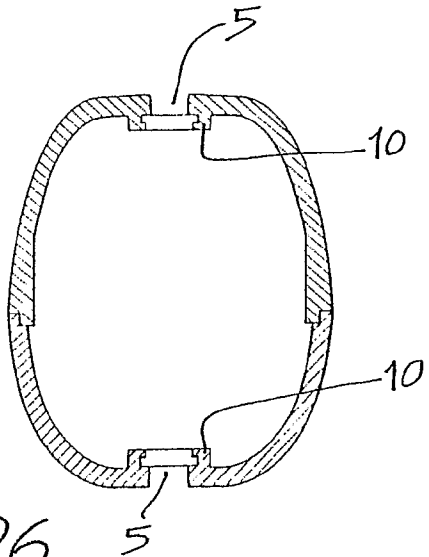
FIG. 26 illustrates a schematic cut taken from FIG. 25, such as indicated by cut line B-B, however taking into consideration only the diffuser structure and now omitting the element of controlling the flow.

FIG. 26 depicts a cut wherein means of controlling the flow were omitted to allow the view of the trails 10 and the openings 5 details incorporated in the hollow part structure 1 that constitutes the present accessory.

Figure 28:
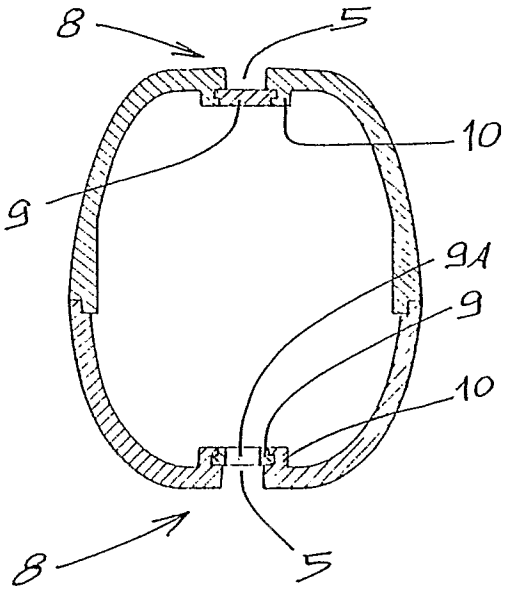
FIG. 28 illustrates a similar view as depicted in FIG. 27, however showing the element of controlling the flow in its open condition.
Figure 27:
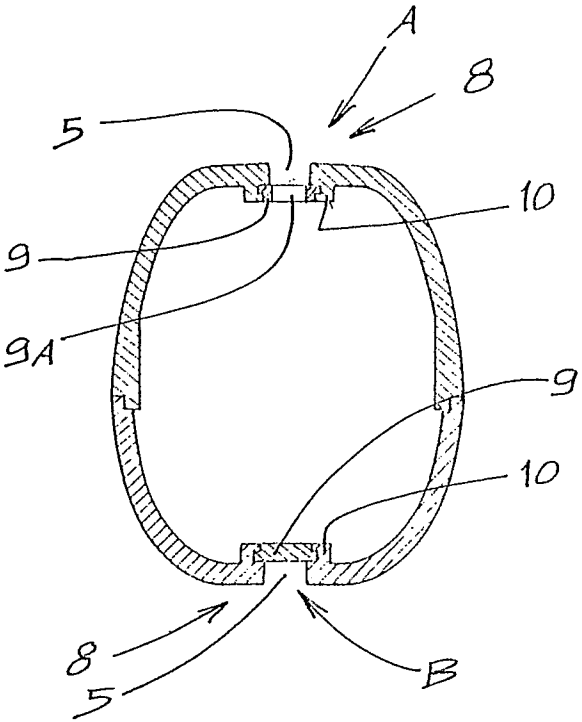
FIG. 27 illustrates a similar cut as depicted in FIG. 26, however taking into consideration the diffuser structure, as well as the element of controlling the flow, which is depicted in its closed condition.

FIG. 27 depicts a similar cut as FIG. 26, however schematically including the strips that define the means of controlling the air flow 8, and in the FIG. 27 it is depicted an opening condition for the passage of air flow through the upper portion of the diffuser, such as indicated by arrow A and of closing or obstruction of flow, such as indicated by arrow B, and on the other side the FIG. 28 illustrates exactly the inverse condition.

FIGS. 27 and 28 demonstrate that the air flow can be conducted in an alternate manner to the upper and lower portions of the hollow part 1, thus allowing a greater control of the drying result that will be obtained.

Figure 29:
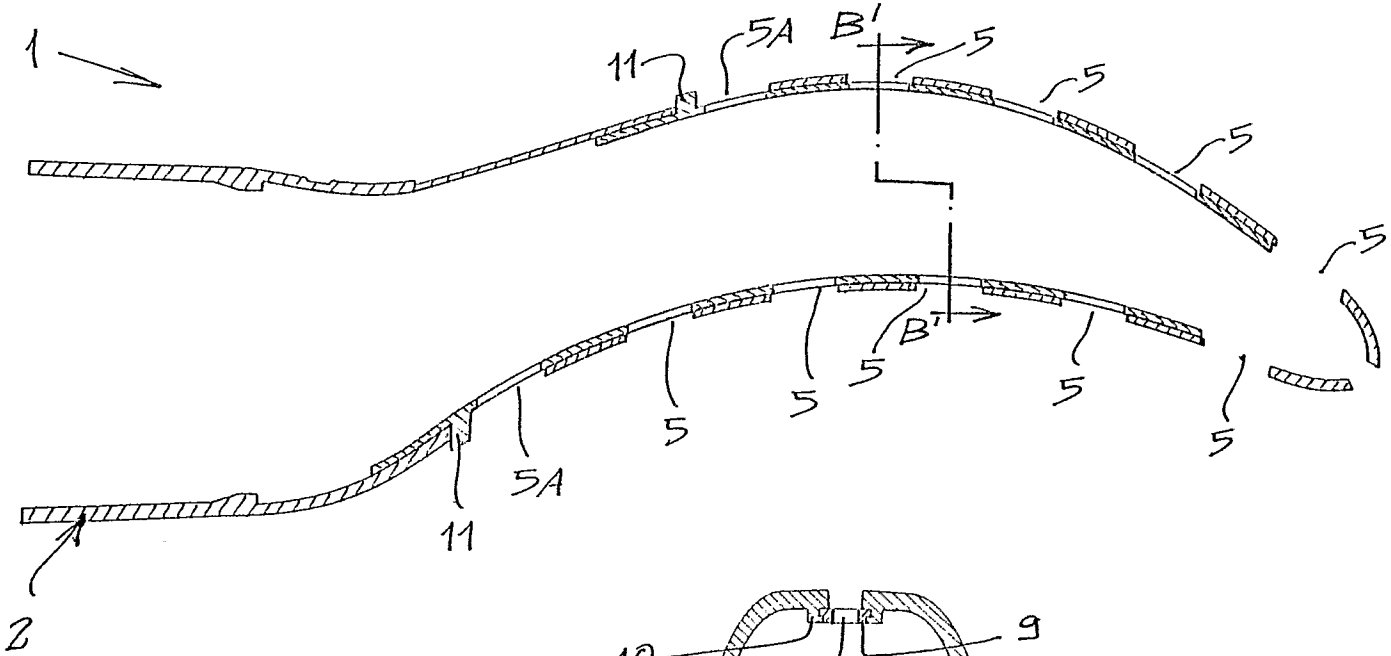
FIG. 29 illustrates a similar view as depicted in FIG. 25, nevertheless said
Figure 30:
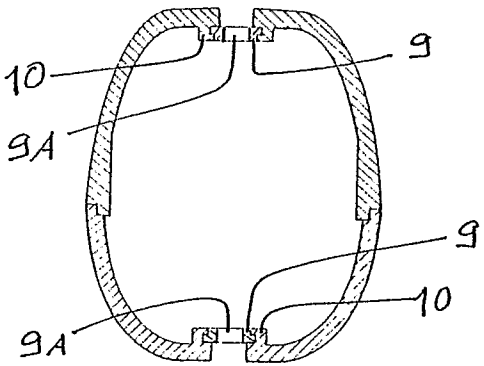
FIG. 30 illustrates a cut taken from FIG. 29, such as indicated by cut line B'-B', showing the means of controlling the flow in its open condition.

FIGS. 29 and 30 depict the diffuser in question in its fully unobstructed condition and wherein the air flow can be applied not only by its lower portion, but also by its upper portion, once the openings 5 and 9A are aligned.

The movement for the means of controlling the air flow 8 is obtained in a simple manner by sliding the flexible material strip 9 along the trails 10, result that is obtained through the actuation over projections 11 that leaves the strip 9 and that are exposed from openings 5A incorporated in the hollow part 1, such as occurring with the openings 5.

Openings 5A exclusively function as mean of dislocation and stroke to the respective projections 11, which can be viewed in FIGS. 23, 24, 25 and 29.

Figure 31:
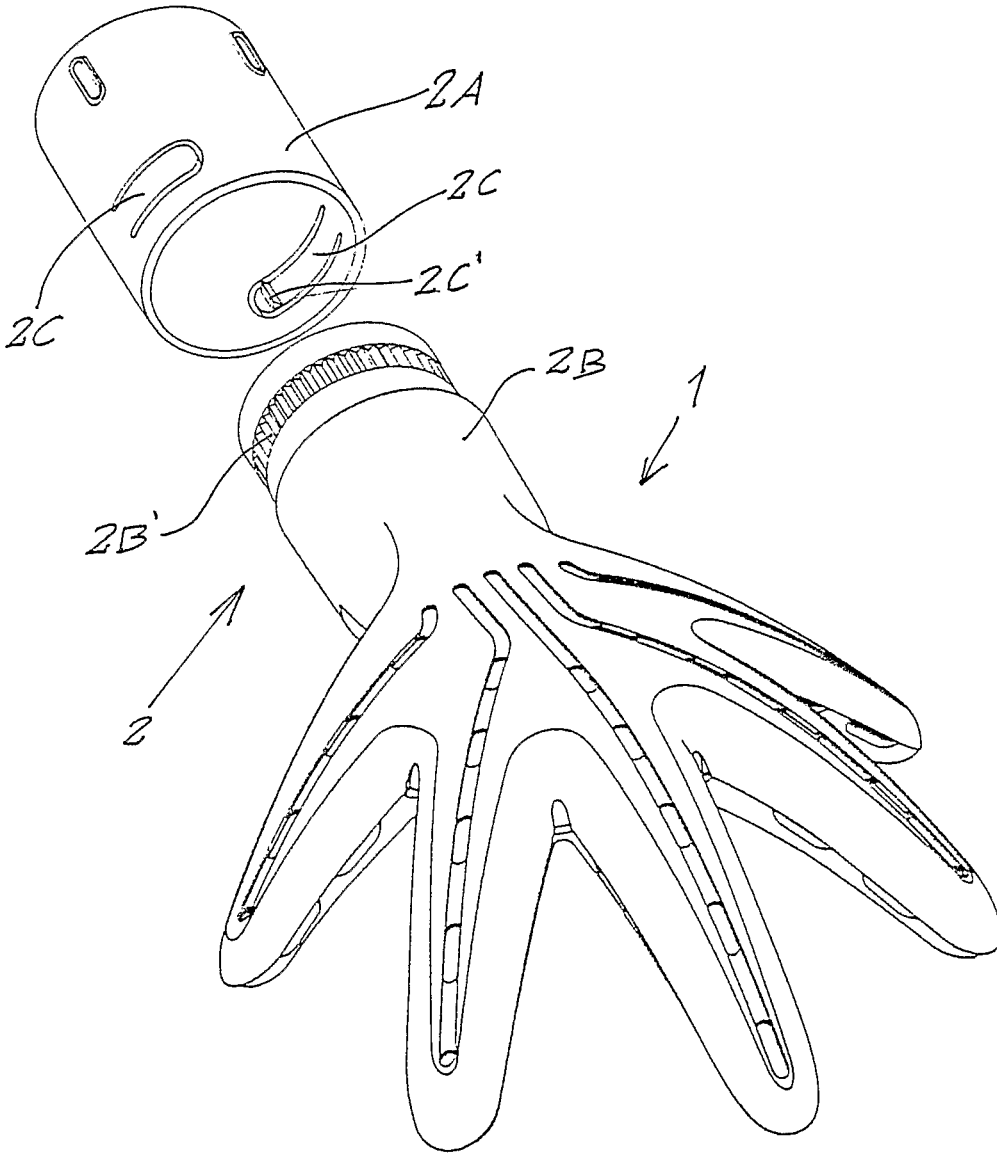
FIG. 31 illustrates an exploded, perspective view wherein the diffuser depicted in the present invention patent is shown separately in relation to its connection terminal.
Figure 32:
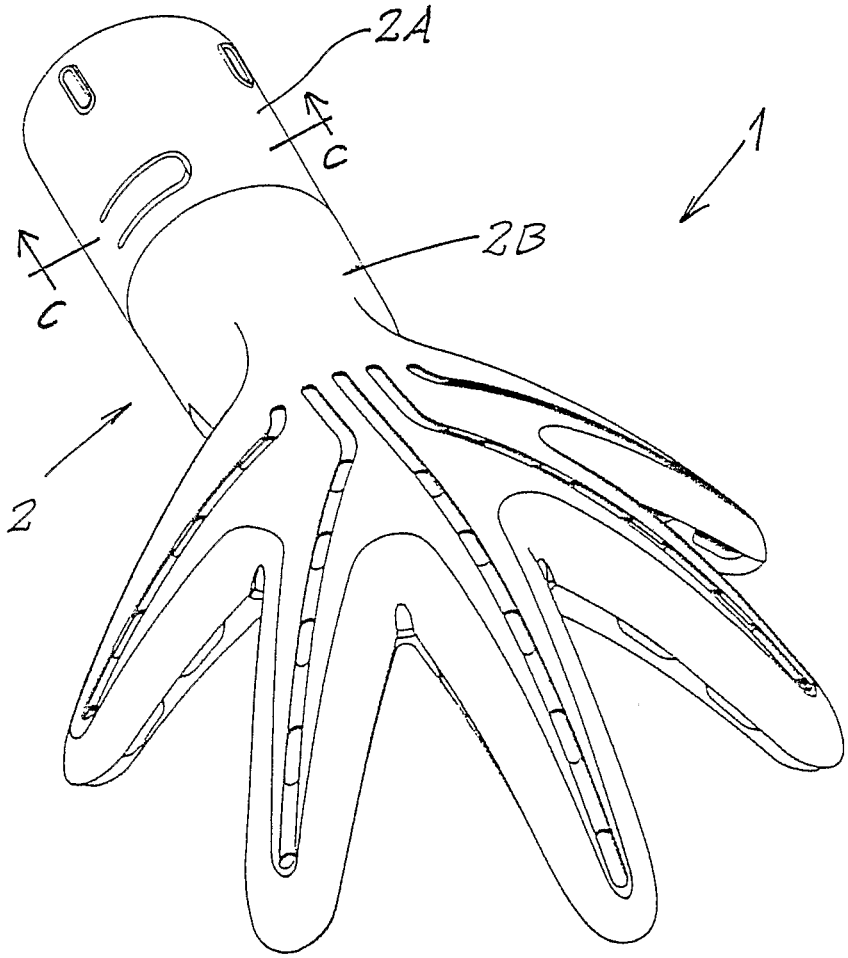
FIG. 32 illustrates a perspective view of the present diffuser being fully mounted.

FIG. 31 illustrates the present accessory within the context in which it is contemplated the provision of means that allow the change of axial position for the accessory as a whole regarding the hair dryer (not shown).

Such change possibility in the position is obtained by the introduction of a connection terminal 2 which includes a rotatably portion 2A, which establishes a link with the integral or fixed portion 2B, being that mounting between both is made through dovetail, where resilient bolts 2C, each with a positioning tooth 2C', getting in touch with teeth 2B' foreseen in the fixed portion 2B of connection terminal 2.

Figure 33:
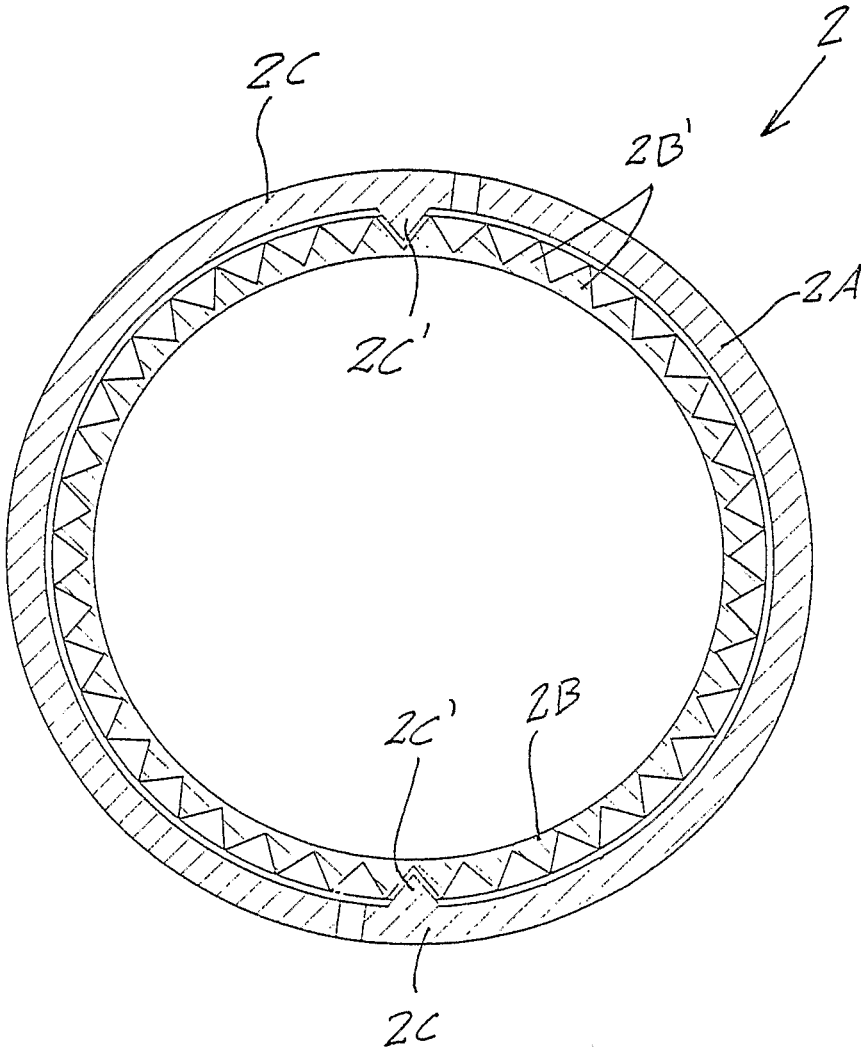
FIG. 33 illustrates a schematic view taken from FIG. 32, such as indicated by cut line C-C.
Figure 34:
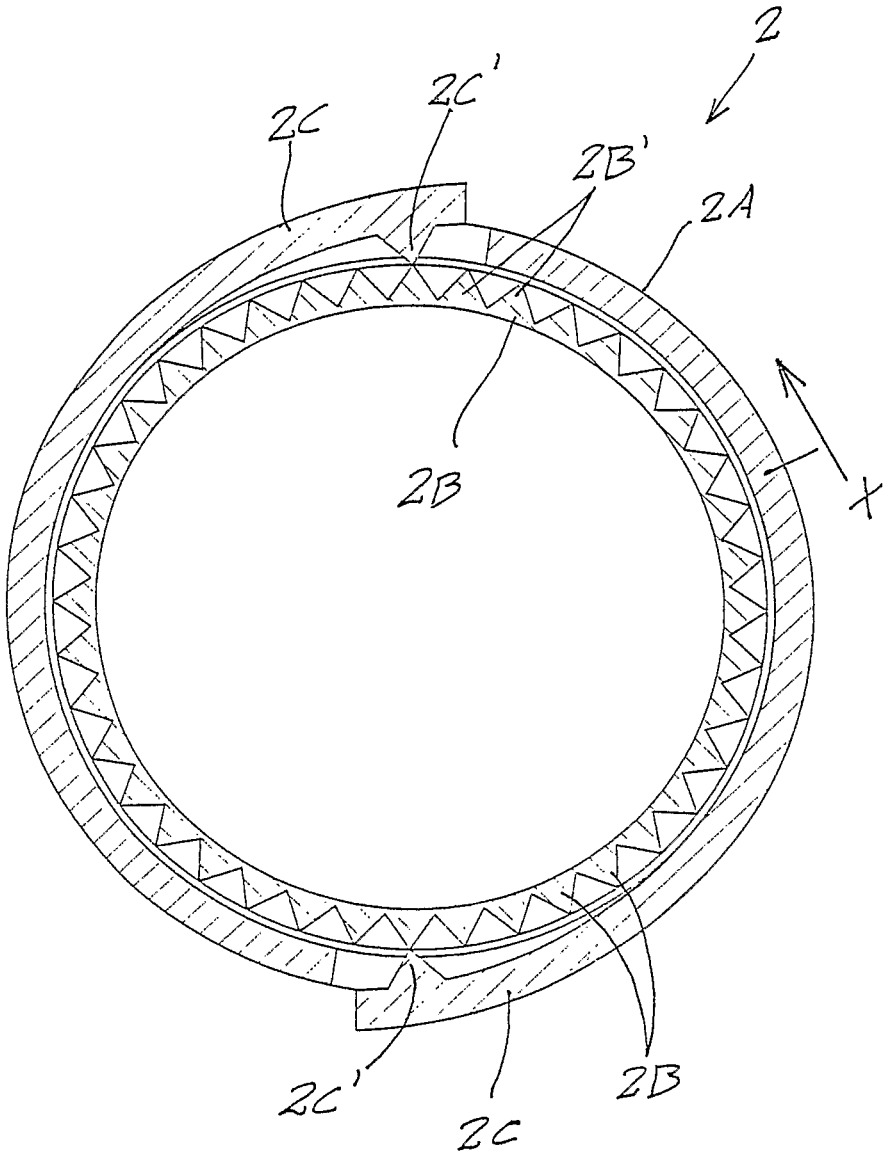
FIG. 34 illustrates a similar view as depicted in FIG. 32, however showing a quick rotation movement among the parts, such as indicated by arrow X.

Mounting between fixed and movable portions of the connection terminal 2 can be better understood through viewing FIGS. 33 and 34.

The connection terminal 2 proposed in this variation is mounted with the dryer using the same means depicted in the original patent, however the rotatably portion 2A (movable in relation to the accessory structure in question), is firmly mounted by dovetail in the hair dryer nozzle (not shown), being rotatably in relation to the fixed portion 2B such as indicated by arrow X of FIG. 34.

When this rotation occurs, the positioning tooth 2C' of resilient bolts 2C exchange space between the teeth 2B' of fixed portion 2B, thus generally altering the positioning of operative portion of accessory, regarding the hair dryer.

The connection terminal 2 depicted in FIGS. 31 to 34 allows the professional operating the dryer to always find the better position to the accessory.

The tooth 2B' are produced in a way that they can establish a diverse range of positions pre-established between the rotatably portion 2A and fixed portion 2B. The resilient bolts 2C are produced integrally to the rostatably portion 2A.

The invention claimed is:

1. An accessory for use together with a hair dryer comprising:

a hollow part formed from an injected piece of plastic, said hollow part having a connection terminal with an essentially tubular body and dimensioned for coupling by locking to an end of a hair dryer, said connection terminal being disposed in an intermediate chamber;

a plurality of hollow projections extending from said connection terminal, each of said hollow projections diverts an air flow from the hair dryer to a series of openings disposed in said projections and the body of said intermediate chamber, wherein said hollow part includes a first section and a second section, said first section includes said connection terminal, an upper side of said intermediate chamber, and said plurality of hollow projections, and said second section includes a lower side of said intermediate chamber and said plurality of hollow projections, and wherein a fixing said second section against said first section is made through projections of pins/housing, distributed along said plurality of hollow projections as well as through a pair of screws connecting said second section to said first section adjacent said connection.

2. An accessory for use with a hair dryer according to claim 1, wherein said connection terminal includes a plurality of retention components assembled in a plurality of openings disposed in a wall of said connection terminal, said plurality of retention components maintain contact projections in an interior a side of said connection terminal that touch said end part.

3. An accessory for use with a hair dryer according to claim 1, wherein said hollow part presents a first variation where a plurality of sectors having an accordion shape connect said hollow projections to a plurality of corresponding movable portions.

4. An accessory for use with a hair dryer according to claim 3, wherein said hollow part includes a spherical connection incorporated into the ends of said movable portions, said spherical connection being locked into the fix end of said hollow projection.

5. An accessory for use with a hair dryer according to claim 1, wherein the hollow part includes a second variation wherein a sector having an accordion shape is incorporated into the region of the connection terminal, allowing for movement among a main portion of the accessory and said connection terminal.

6. An accessory for use with a hair dryer according to claim 1, wherein said hollow part includes a means for controlling an air flow, said means for controlling an air flow being internally mounted to a diffuser structure, said means for controlling an air flow being a plurality of flexible material strips mounted in a plurality of trails incorporated in said hollow part; said means for controlling an air flow being projected, mounted, and dislocated as indicated by arrows (X-Y); said plurality of flexible strips have a plurality of openings in alignment with a plurality of hollow part openings disposed in said hollow part configured to include a passage of air flow therethrough, and in the opposite way, when said openings are not aligned, it occurs the obstruction of air passage; each of said flexible material strips includes a projection extending from a plurality of hollow part openings.

7. An accessory for use with a hair dryer according to claim 1, wherein said hollow part includes a means for altering an axial position of the accessory, upon said connection terminal, further including a rotatable portion connected with a fixed portion wherein a mounting therebetween is a dovetail, where a plurality of resilient bolts each having a positioning tooth engages a plurality of teeth in a fixed portion of said connection terminal.

* * * * *